United States Patent [19]

Butterworth

[11] Patent Number: 4,666,381

[45] Date of Patent: May 19, 1987

[54] LUBRICANT DISTRIBUTION SYSTEM FOR SCROLL MACHINE

[75] Inventor: Arthur L. Butterworth, La Crosse, Wis.

[73] Assignee: American Standard Inc., New York, N.Y.

[21] Appl. No.: 839,316

[22] Filed: Mar. 13, 1986

[51] Int. Cl.[4] ..... F01C 1/04; F01C 21/04; F01C 18/04; F01C 29/02

[52] U.S. Cl. ..... 418/55; 418/88; 418/94; 184/6.18

[58] Field of Search ..... 418/55, 88, 94; 184/6.16, 6.18

[56] References Cited

U.S. PATENT DOCUMENTS 4,403,927 9/1983 Butterworth et al. ..... 418/55

FOREIGN PATENT DOCUMENTS 55-64181 5/1980 Japan ..... 418/88
56-9601 1/1981 Japan ..... 418/55
58-65986 4/1983 Japan ..... 418/94

*Primary Examiner*—John J. Vrablik
*Attorney, Agent, or Firm*—Ronald M. Anderson; William J. Beres; Robert J. Harter

[57] ABSTRACT

An oil distribution system for supplying lubricating oil to a thrust bearing, the bearing surfaces of an Oldham coupling, and a swing link bearing in a scroll compressor and allocating the oil between the bearings in proper proportion. Oil is pumped from a reservoir in the bottom of the compressor shell upward through a gallery that runs the length of a rotating drive shaft. The oil exits an opening at the top of the drive shaft and is thrown radially outward into a shallow cavity formed in a swing link that is rotatably driven by the shaft. The cavity is generally elongate in shape, so that oil collects in pools at each of its ends as a result of centrifugal force. Each of the two bearings is lubricated by oil that flows upward into the bearings either directly or through a passage from the pools of oil. The shape of the cavity and the position of the gallery opening within the cavity determine the proportion of oil flowing out of the gallery that is supplied to each bearing, insuring that each bearing is properly lubricated.

18 Claims, 12 Drawing Figures

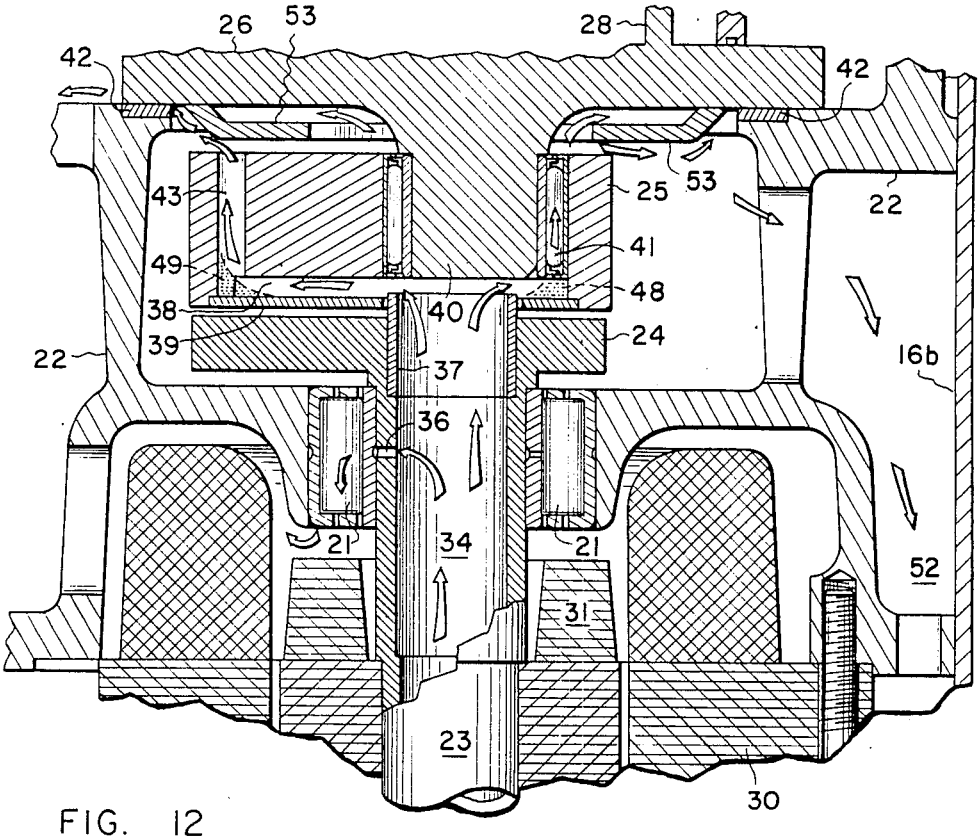
FIG. 12
FIG. 11
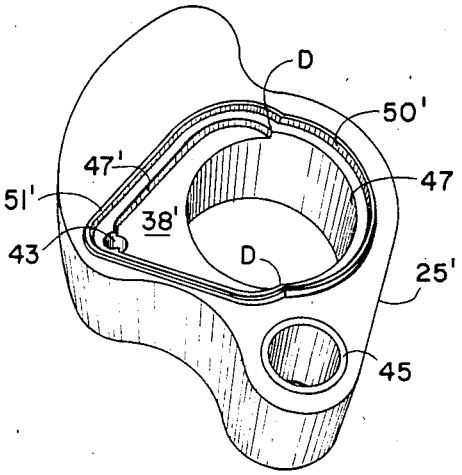

LUBRICANT DISTRIBUTION SYSTEM FOR SCROLL MACHINE

TECHNICAL FIELD

This invention generally pertains to a lubricant distribution system for a scroll machine and specifically, to a system for allocating oil in predetermined proportion for proper lubrication of a thrust and a swing link bearing.

BACKGROUND ART

As in other machinery having a rotating vertical shaft, most scroll machines commonly provide oil to bearings requiring lubrication by means of an oil passage that extends through the shaft. The oil is typically conveyed up this passage from a reservoir in which the lower end of the drive shaft is immersed, and is supplied to each bearing through radial side passages. This system works well for supplying oil to drive shaft bearings and other bearing surfaces directly accessible from the central shaft oil passage, but generally cannot efficiently supply lubricant to bearings that are spatially separated from the passage, particularly if such bearings must receive a substantial proportion of the total lubricant flow.

This problem is addressed in U.S. Pat. No. 4,403,927 which has been assigned to the same assignee as the present application. The invention disclosed therein provides an oil collector cup around the top of the passage through the drive shaft. The collector cup is connected to the lower surface of the swing link and underlies both a swing link bearing and a passage formed adjacent the swing link bearing, in fluid communication with a thrust bearing and the sliding surfaces of an Oldham coupling. An arcuate-shaped baffle disposed immediately below the swing link bearing deflects a portion of the oil flowing into the cup upward, into the swing link bearing. The remainder of the oil is available to lubricate the thrust bearing and Oldham coupling.

Although the oil distribution system described in U.S. Pat. No. 4,403,927 operates well to proportionately allocate oil between the bearings, it has several deficiencies that have become evident during manufacturing design development. It has been found difficult to fabricate the collector cup and arcuate baffle with the necessary axial tolerance to insure that the top of the baffle is in contact with the bottom of the swing link bearing. If there is a gap between the baffle and the bearing, oil that should flow upward into the swing link bearing from the collector cup instead leaks through the gap. Thus, the swing link bearing does not receive adequate lubrication.

The collector cup/baffle is also somewhat expensive to manufacture and assemble. In addition, the groove or passage formed in the swing link (adjacent its bearing and used to convey oil to the thrust bearing and Oldham coupling) compromises the support of the swing link bearing.

In consideration of these problems, it is an object of the subject invention to distribute oil to the bearings of a scroll machine in proportion to their requirements for lubrication.

It is a further object to distribute oil between a swing link bearing, and a thrust bearing and the sliding surfaces of an Oldham coupling in predetermined proportion as required to meet their lubrication needs.

Yet a further object is to provide a relatively low-cost oil distribution system for a scroll machine.

These and other objects of the invention will become apparent from the description of the preferred embodiment which follows and by reference to the attached drawings.

SUMMARY OF THE INVENTION

The subject invention is an oil distribution system for lubricating the bearings of a scroll machine. It includes a rotatably driven vertical shaft having an oil pump on its lower end that extends into a reservoir of oil. An internal oil gallery in the shaft conveys oil from the pump to its upper end, on which is mounted a swing link rotatably driven by the shaft.

An oil collecting cavity is disposed in the swing link, around the open end of the gallery through the shaft, and is in receipt of oil that flows out when the pump is operating. The cavity has a generally elongate shape, with one end disposed adjacent the lower end of a first bearing and the other end disposed to deliver oil to a second bearing. Both the shape of the cavity and the position of the open end of the gallery within the cavity between its two ends control the relative allocation of oil between the first and second bearings.

BRIEF DESCRIPTION OF THE DRAWINGS

FIG. 11 is a perspective view of a second embodiment of the oil collecting cavity formed in a swing link, with its cover plate removed.

FIG. 12 is an enlarged cross-sectional view of the compressor shown in FIG. 1, illustrating with the use of arrows, the flow of oil to various bearing surfaces in the top portion of the machine.

DESCRIPTION OF THE PREFERRED EMBODIMENTS

Figure 2:
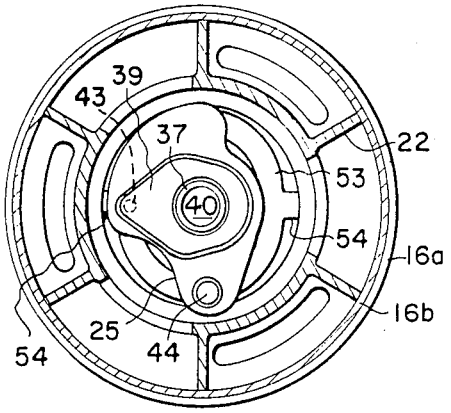
FIG. 2 is a cross-sectional view showing the lower surface of the swing link, taken along section lines 2—2 of FIG. 1.
Figure 1:
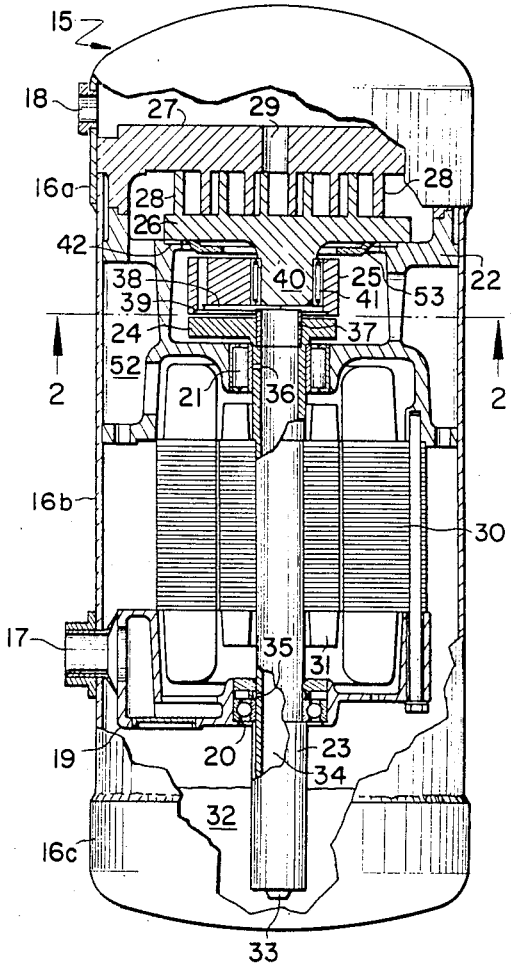
FIG. 1 is a cutaway view of a hermetic scroll compressor incorporating the subject invention, showing the internal mechanism in cross section.

Referring to FIG. 1, a scroll compressor generally denoted by reference numeral 15 is shown, that includes the subject lubricant distribution system. Compressor 15 has a hermetic shell comprising a top cap **16*a*, a cylindrical portion 16*b*, and a bottom cap 16*c*, fitted and welded together in overlapping relation. A suction port 17 extends through shell portion 16*b* and is operative as an inlet through which refrigerant to be compressed is conveyed inside hermetic shell 16. After the fluid has been compressed, it exits shell 16 through a discharge port 18 which is disposed in hermetic shell section 16***a*.

As shown in the cutaway view of FIG. 1, a lower framework 19 is used to support drive shaft bearing 20. Likewise, an upper drive shaft bearing 21 is supported and centered by an upper supporting framework 22 that extends radially into press fit contact with the interior surface of hermetic shell 16. Framework 22 thus supports the working mechanism of compressor 15 inside shell 16 in both the vertical and horizontal planes.

A drive shaft 23 extends through lower and upper drive shaft bearings 20 and 21, and on its upper end includes an offset crank 24. Shaft 23 is drivingly connected to swing link 25, which in turn is connected to scroll plate 26 in a manner that causes it to move in an orbital path as shaft 23 rotates. A fixed scroll plate 27 is disposed opposite to and parallel with the orbiting scroll plate 26, and is joined to upper supporting frame 22. An Oldham coupling ring 53 disposed between swing link 25 and scroll plate 26 constrains scroll plate 26 to orbit in fixed angular relationship relative to scroll plate 27. Both the orbiting and fixed scroll plates 26 and 27 have involute wraps 28 extending from their facing surfaces in intermeshed relationship. Fluid entering the compressor through suction port 17 is compressed within pockets (not shown) formed between the involute wraps 28 as orbiting scroll plate 26 moves in orbital relationship to fixed scroll plate 27, and flows out through passage 29 before exiting the compressor shell at discharge port 18.

Drive shaft 23 is rotatably driven by electric motor 30. A rotor 31 is press fit onto drive shaft 23 so that the shaft rotates when motor 30 is energized from an electric power source. The lower end of drive shaft 23 extends down into a reservoir of oil 32. As drive shaft 23 rotates, a centrifugal oil pump 33 disposed on the lower end of the shaft picks up oil from reservoir 32 and forces it up through an internal gallery 34 that extends the length of the shaft. A small portion of the oil flowing up gallery 34 exits radially outward through lateral passage 35 to lubricate the lower drive shaft bearing 20 and through lateral passage 36 to lubricate the upper drive shaft bearing 21. The remainder of the oil passes out through a standpipe insert 37 that is fitted into gallery 34 at the upper end of the drive shaft 23 and which extends slightly above the upper surface of crank 24. Oil exiting gallery 34 through standpipe 37 is thrown radially outward into an oil collecting cavity 38 that is formed in the lower surface of swing link 25. A cover plate 39 fitted around the extending end of standpipe 37 encloses oil collecting cavity 38.

As shown in FIGS. 2–6 and FIG. 7, oil collecting cavity 38 is a shallow planar depression, generally ovular in shape, with one end having a relatively smaller radius of curvature than the other end. The end with the smaller radius of curvature intersects the open end of a passage 43 that extends vertically through swing link 25. The relatively larger radius end lies immediately below a swing link bearing 41 in which the orbiting scroll plate stub 40 is rotatably seated. The lower end of stub 40 comprises a substantial portion of the planar area of cavity 38 when swing link 25 is installed in compressor 15. Rotation of drive shaft 23 is transmitted to swing link 25 by means of crankpin 44 which extends upward from crank 24 into a journal bearing 45 disposed in one lobe of the swing link. Swing link 25 thus converts the rotational motion of drive shaft 23 into an orbital motion applied to drive orbiting scroll plate 26 through stub 40. This arrangement provides radial compliance between involute wraps 28 that is generally absent in direct-drive scroll compressors of conventional design.

Figure 3:
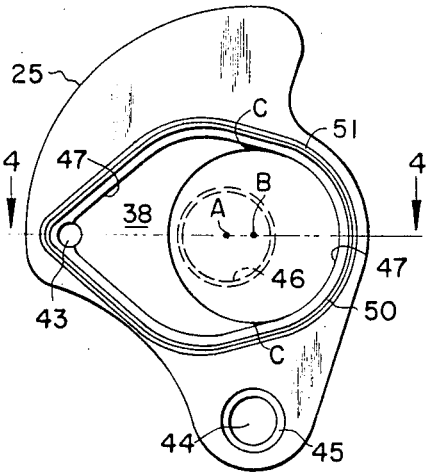
FIG. 3 is a plan view of the swing link showing a first embodiment of the oil cavity (with its cover plate removed).

FIG. 3 shows swing link 25 with oil collecting cavity cover plate 39 removed, to better illustrate the shape of cavity 38 and its disposition relative to stub 40, standpipe 37, and oil passage 43. The circular dashed lines 46 in FIG. 3 show the placement of standpipe 37 and the larger circular cutout for the standpipe within the cavity cover plate 39. The center of rotation of the drive shaft and its longitudinal axis of rotation is denoted by "A". Oil exiting gallery 34 is thrown radially outward in all directions relative to point "A" from the inner surface of standpipe 37 represented by the smaller diameter circle defined by dashed line 46. This oil flows radially outward until it contacts an intersecting surface, i.e., the peripheral sidewall 47 of oil collecting cavity 38. Once the lubricating oil strikes an intersecting surface, its direction of flow toward either the smaller radius end or the larger radius end of cavity 38 depends upon the angle a line tangent to that surface forms with a radial line through point "A". Point "B" shown in FIGS. 3, 5, 7, 8, and 10 denotes the center of the cylindrical hole 47 which extends through swing link 25 and in which swing link bearing 41 is normally seated. In addition, point "B" represents the center for the radius of curvature of the larger radius end of oil collection cavity 38. The letter "C" in FIG. 3 designates the two points on the peripheral sidewall 47 of oil collecting cavity 38 where a tangent to the sidewall forms an angle of 90° with a radial line through point "A".

Figure 7:
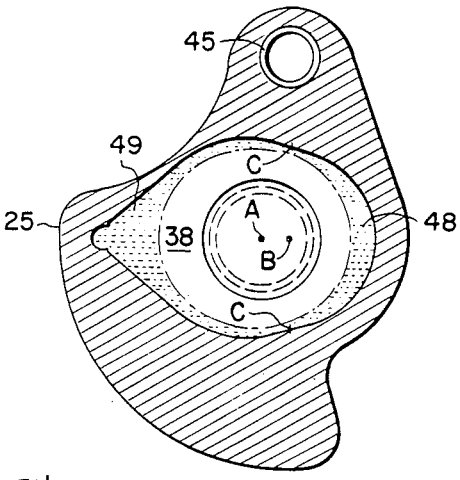
FIG. 7 is a cross-sectional view of the swing link taken along section line 7—7 of FIG. 6.

It should be apparent that oil impacting sidewall 47 on the portion that extends around the right side of cavity 38 between the two points designated "C" will collect in an arcuate-shaped pool 48 on the larger radius end of cavity 38, whereas oil impacting sidewall 47 on the portion that extends around the smaller radius end between the two points designated "C" will collect in an arcuate-shaped pool 49 at that end (See FIGS. 7 and 12). It is the centrifugal force resulting from the rotation of swing link 25 that causes the oil striking sidewall 47 to flow along the sidewall toward one end or the other of oil collecting cavity 38, the direction of flow depending upon the angle of a line tangent to sidewall 47 relative to the radial line through point "A". The oil will always flow in a direction which carries it "downhill" (i.e., away) from point "A", since to do otherwise, the oil would have to flow "uphill" against the centrifugal force resulting from rotation of swing link 25.

It will be apparent from inspection of FIG. 3 that a substantial portion of the cavity sidewall 47 that extends around the larger radius end of oil collection cavity 38 is congruent with the bore in swing link 25 in which swing link bearing 41 is seated. Oil collected in pool 48 at that end of the cavity 38 is thus available to lubricate swing link bearing 41 as drive stub 40 rotates therein. Since the resistance to oil flow through a bearing is likely to be much greater than through an open passage, the rate of flow of oil from pool 48 through bearing 41 is also likely to be relatively slow compared to the rate at which oil may flow upward through passage 43 from pool 49 at the opposite end of cavity 38. As a result, oil in excess of the lubricant requirements of bearing 41 is more likely to accumulate, increasing the relative volume of oil in pool 48. This excess oil can only build up to a point, however, since once the corners of arcuate pool 48 extend beyond points "C", oil will begin to flow from pool 48 into pool 49. It will thus be apparent, that the shape and disposition of oil collection cavity 38 within swing link 25 relative to gallery 34 control the allocation of oil between pools 48 and 49. This, in turn, controls the amount of lubricant supplied from each of the respective pools 48 and 49 to bearings which receive lubrication from oil collected therein, as explained further hereinbelow.

Figure 4:
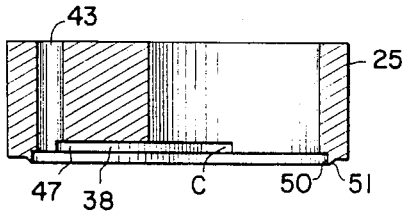
FIG. 4 is a cross-sectional view of the swing link taken along section lines 4—4 of FIG. 3.
Figure 5:
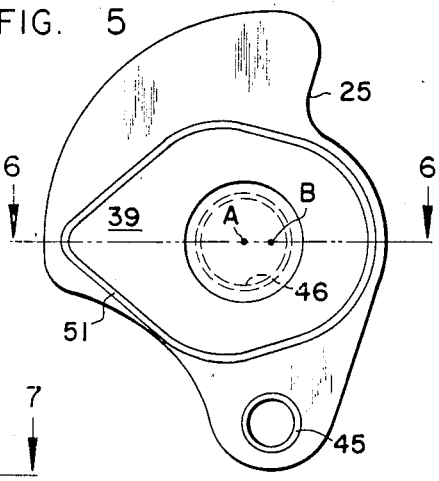
FIG. 5 is a plan view of the swing link showing the first embodiment of FIG. 3 with the cover plate in place.
Figure 6:
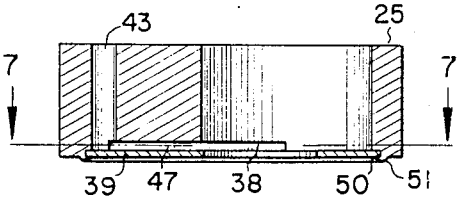
FIG. 6 is a cross-sectional view of the swing link taken along section lines 6—6 of FIG. 5.
Figure 8:
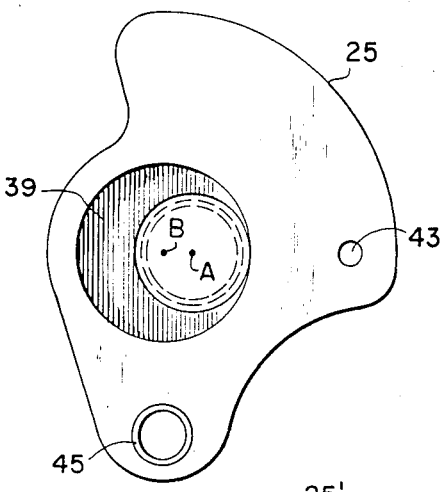
FIG. 8 is a plan view of the swing link showing its upper surface.

FIGS. 3 and 4 show swing link 25 prior to the installation of the oil collector cavity cover plate 39, whereas FIGS. 5 and 6 show the swing link with the cover plate installed. Cover plate 39 is installed within a groove 50 that is formed adjacent sidewall 47 of the oil collector cavity. A ridge 51 extends around and above the perimeter of groove 50, and is rolled over or otherwise deformed to retain cover plate 39 in its installed position within groove 50. This method of manufacture precisely locates cover 39 on the lower surface of swing link 25, thereby insuring a precision fit around standpipe 37. FIG. 8 shows swing link 25 viewed from the top with cover plate 39 installed and visible through the bore in which swing link bearing 41 is normally seated. This view clearly illustrates that bearing 41 is exposed to lubricant collected in pool 48 over an extended portion of its lower circular end. This helps to insure proper lubrication of bearing 41.

Figure 10:
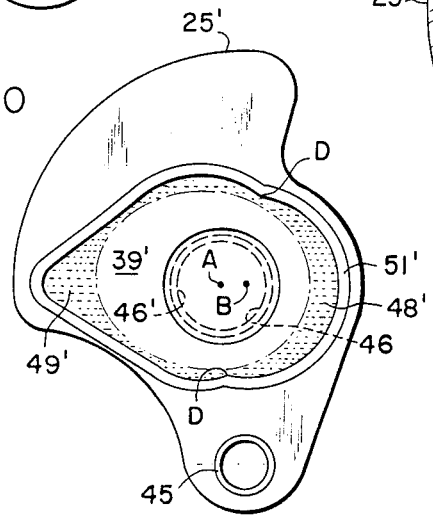
FIG. 10 is a plan view of the swing link showing a second embodiment for the oil collecting cavity.

Referring now to FIGS. 10 and 11, a second embodiment of the invention is shown wherein an oil collection cavity 38' is formed in the lower surface of swing link 25'. The second embodiment differs primarily from the first in the shape of this cavity, but otherwise functions in substantially the same fashion to allocate lubricant flow from standpipe 37 into oil pools 48' and 49' that form at each end of cavity 38'. Since the functions of the elements discussed herein are substantially the same as in the first embodiment, in the second embodiment, they are designated by the use of prime reference numerals.

In the embodiment shown in FIG. 10, the letter "D" designates the points on the sidewall 47' at which oil flowing from standpipe 37 radially outward from point "A" divides to flow either toward pool 48' or pool 49', dependent upon which side of point "D" the oil impacts against sidewall 47'. With reference to FIG. 10, if the oil impacts the sidewall to the right of a straight line connecting points "D", it collects in a pool 48', and if on the left, in a pool 49'. It will be apparent by inspection, that points "D" on sidewall 47' are radially closer to point "A" than any other points thereon. Due to the centrifugal force resulting from the rotation of swing link 25', oil impacting sidewall 47' will always flow in a direction radially away from center point "A" or "downhill". The position of points "D" relative to point "A" and the shape of cavity 38' again determine the relative allocation of oil flowing out of standpipe 37 into cavity 38'.

Figure 9:
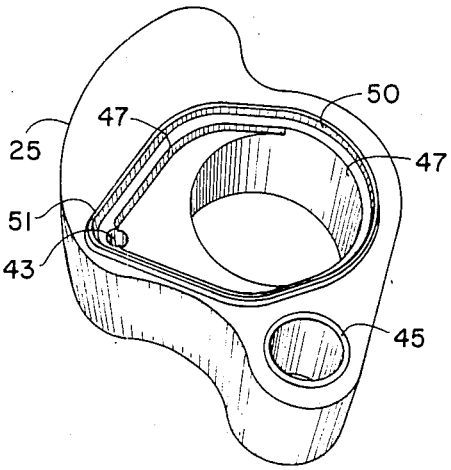
FIG. 9 is a perspective view of the swing link prior to installation of the cavity cover plate.

A cover plate 39' is likewise fitted into a groove 50' and secured in place by deformation of a peripheral ridge 51' as was previously discussed in the first embodiment. The perspective views of the swing links 25 and 25' shown respectively in FIGS. 9 and 11 clearly illustrate the differences between the first and second embodiment.

Turning now to FIG. 12, a sectional view of part of the upper portion of scroll compressor 15 illustrates the flow of lubricant up through gallery 34 within drive shaft 23. Outlined arrows are used to indicate the general direction of oil flow and allocation to various bearing surfaces, as for example, the oil exiting gallery 34 through lateral passage 36 to provide lubrication of upper drive shaft bearing 21. The majority of oil flowing upwardly through gallery 34 exits through standpipe 37, being thrown radially outward into oil collection cavity 38. This oil collects in pools 48 and 49 as previously explained hereinabove. From pool 48, oil flows upwardly through swing link bearing 41, and after passing through bearing 41, is thrown radially outward as a mist of oil droplets that impinge upon thrust bearing 42, on the sliding surfaces (not shown) of Oldham coupling 53, onto frame member 22, and onto the interior surface of hermetic shell portion **16*b*. Oil impacting on any such surface, eventually flows downwardly through passage 52 (or into bearing 21), returning finally to oil reservoir 32**.

Oil accumulating in pool 49 flows upwardly through passage 43 in swing link 25, and is thrown radially outward therefrom to impact on and lubricate thrust bearing 42 and Oldham coupling 53. Oldham coupling ring 53 includes four tabs 54 (two partially shown in FIG. 2) that extend radially outward to engage two slots (not shown) disposed in the back of scroll plate 26 and two slots (not shown) disposed in frame 22. The function of such a coupling is well known to those skilled in the art. Oil impacting on Oldham coupling ring 53 lubricates tabs 54 as they slide within the slots. Thrust bearing 42 is seated partially within frame 22 and provides axial support against the back surface of orbiting scroll plate 26. Oil passing through thrust bearing 42 and out of Oldham coupling ring 53 continues radially outward and flows back into oil reservoir 32.

The second embodiment indicated by the prime numerals as disclosed hereinabove operate substantially the same way, with oil collected in pool 48' providing primary lubrication to swing link bearing 41, and oil collected in pool 49' providing primary lubrication to thrust bearing 42. In all other respects, the second embodiment generally functions in substantially the same way as the first embodiment. The two embodiments of oil collection cavity 38 and 38' illustrate how variations in the shape of the cavity can be made without affecting its operative function in allocating oil flow from gallery 34 between bearing 41, the sliding slots and tabs 54 of Oldham coupling ring 53, and bearing 42. Various other modifications to the shape and disposition of oil collection cavity 38 or 38' relative to oil gallery 34 to achieve a similar result, will be apparent to those skilled in the art. For example, oil gallery 34 could be located off the central axis of rotating drive shaft 23 such that oil exiting the gallery would flow radially outward from a standpipe not concentric with point "A". In this instance, an appropriate modification in the shape of oil collection cavity 38 would be required to achieve proper lubricant distribution. These and other modifications will be apparent to those skilled in the art within the scope of the claims that follow hereinbelow.

I claim:

1. An oil distribution system for lubricating bearings of a scroll machine having an orbiting scroll plate, said oil distribution system comprising a rotatably driven vertical shaft having an oil pump on its lower end extending into a reservoir of oil, and including an internal oil gallery through which oil is conveyed from the pump to the upper end of the shaft on which is mounted a swing link, said swing link being pivotally connected to the drive shaft and rotatably connected to the orbiting scroll plate;

an oil collecting cavity disposed in the swing link, around the open end of the oil gallery in said driven shaft and in receipt of oil flowing out of the oil gallery when the pump is operating, said cavity having a generally elongate arcuate shape, with one end of the cavity disposed adjacent the lower end of a first bearing and the other end of the cavity disposed to deliver oil to a second bearing, said one end of the cavity being disposed closer to the gallery than the other end, the shape of the cavity and the position of the open end of the gallery within the cavity between its two ends controlling the relative allocation of oil between the first and second bearings.

2. The oil distribution system of claim 1 wherein oil exiting the oil gallery in the drive shaft is distributed radially toward a sidewall that defines the shape of the cavity within the swing link, and upon contacting the sidewall flows along it to collect in pools at one end of the cavity or the other, depending upon where the oil contacts the sidewall and the angle of a tangent to the sidewall at the point of contact relative to the direction of the oil's path prior to contact.

3. The oil distribution system of claim 2 wherein the pools of oil form an arcuate shaped meniscus at each end of the cavity.

4. The oil distributing system of claim 3 wherein oil flows from one pool to the other pool once the ends of the arcuate shaped meniscus of the one pool reach a point on the cavity sidewall where the radial separation between the sidewall and the center of rotation for the swing link is a minimum.

5. The oil distribution system of claim 4 wherein there are two points on opposite sides of the cavity where the radial separation is a minimum and wherein oil thrown radially outward from the gallery into the cavity flows into the pool at said one end of the cavity if it impacts a first portion of the sidewall, where said first portion of the sidewall extends between the two points around said one end of the cavity, and the oil flows into the pool at said other end of the cavity if it impacts a second portion of the sidewall where said second portion of the sidewall extends between the two points around said other end of the cavity.

6. The oil distribution system of claim 1 wherein the cavity is generally ovular in shape.

7. The oil distribution system of claim 1 wherein the cavity includes a sidewall that curves radially inward to define a first and a second point on opposite sides of the cavity, with the space between each point on the sidewall and the center of rotation of the swing link being a minimum compared to the space between said center and the remainder of the sidewall.

8. The oil distribution system of claim 1 wherein the scroll machine orbiting scroll plate includes a drive stub rotatably connected to the swing link by the first bearing.

9. The oil distribution system of claim 1 wherein the second bearing comprises an annular thrust bearing and wherein the scroll machine further includes an Oldham coupling to which oil is delivered generally in the same manner it is delivered to the thrust bearing.

10. In a scroll compressor including a first and a second bearing, a rotatably driven vertical drive shaft extending downward into an oil reservoir, a swing link rotatably driven by the drive shaft and pivotally mounted on its upper end, and an orbiting scroll plate rotatably connected to the swing link, an oil distribution system for delivering oil in predetermined proportion to the first and second bearings comprising an oil pump disposed on the lower end of the drive shaft and operative when the shaft is rotating to force oil to flow from the reservoir upward within a gallery disposed within the drive shaft, and out through an opening on the upper end of the shaft; and a shallow oil collecting cavity formed in the swing link around the gallery opening at the upper end of the drive shaft in receipt of oil flowing out of the opening as the drive shaft rotates, said cavity including a sidewall that defines a closed curve having a generally elongate arcuate shape with a varying radius of curvature and having two ends disposed along a longitudinal axis that extends across the gallery opening, with one end of the cavity disposed beneath the first bearing and closer to the gallery than the other end, and the other end disposed beneath a passage that is in fluid communication with the second bearing, oil flowing out of the opening to collect in a pool at each end of the cavity, the proportion flowing to each end of the cavity being determined by the shape of the cavity and the position of the gallery opening along said longitudinal axis, and oil thus collected in the pools being delivered by centrifugal force to the first and second bearings in proper proportion to provide adequate lubrication to each bearing.

11. The oil distribution system of claim 10 wherein the pools of oil form an arcuate shaped meniscus at each end of the cavity.

12. The oil distribution system of claim 11 wherein oil flows from one pool to the other pool once the ends of the arcuate shaped meniscus of the one pool reach a point on the cavity sidewall where the radial distance between the center of rotation of the swing link and the sidewall is a minimum.

13. The oil distribution system of claim 10 wherein the cavity is generally ovular in shape with said one end of the cavity having a larger radius of curvature than said other end.

14. The oil distribution system of claim 13 wherein the opening into the oil gallery is disposed radially closer to the end of the cavity with the larger radius of curvature than to the other end.

15. The oil distribution system of claim 10 wherein the cavity sidewall curves radially inward to define a first and a second point on opposite sides of the cavity, with the space between each point and the center of rotation of the swing link being a minimum compared to the space between said center and the remainder of the sidewall.

16. The oil distribution system of claim 10 wherein the scroll compressor orbiting scroll plate includes a drive stub connected to the swing link by the first bearing.

17. The oil distribution system of claim 16 wherein the second bearing is an annular thrust bearing and wherein the scroll machine further includes an Oldham coupling that is lubricated by oil flowing through the passage used to supply oil to lubricate the thrust bearing.

18. The oil distribution system of claim 17 wherein most of the oil that is supplied to the first bearing passes through it and is then thrown radially outward toward the thrust bearing and the Oldham coupling to provide additional lubrication for them.

* * * * *